US011337469B2

(12) United States Patent
Tuan et al.

(10) Patent No.: US 11,337,469 B2
(45) Date of Patent: May 24, 2022

(54) RESPIRATORY PROTECTION DEVICE AND PROCESSES FOR PRODUCING THE SAME

(71) Applicant: Masgick, Inc., Taipei (TW)

(72) Inventors: Rui-Hong Tuan, Nantou (TW); Yu-Chieh Liang, Nantou (TW); Benchiao Jai, Taipei (TW)

(73) Assignee: Masgick, Inc., Taipei (TW)

( * ) Notice: Subject to any disclaimer, the term of this patent is extended or adjusted under 35 U.S.C. 154(b) by 644 days.

(21) Appl. No.: 16/321,475

(22) PCT Filed: Aug. 17, 2017

(86) PCT No.: PCT/CN2017/097787

§ 371 (c)(1),
(2) Date: Jan. 29, 2019

(87) PCT Pub. No.: WO2018/033108

PCT Pub. Date: Feb. 22, 2018

(65) Prior Publication Data

US 2021/0321687 A1 Oct. 21, 2021

Related U.S. Application Data

(60) Provisional application No. 62/375,909, filed on Aug. 17, 2016.

(51) Int. Cl.
*A41D 13/11* (2006.01)
*A62B 23/02* (2006.01)

(52) U.S. Cl.
CPC ..... *A41D 13/1115* (2013.01); *A41D 13/113* (2013.01); *A41D 13/1161* (2013.01);
(Continued)

(58) Field of Classification Search
CPC ..... A62B 23/00; A62B 23/02; A62B 23/025; A41D 13/11; A41D 13/1107;
(Continued)

(56) References Cited

U.S. PATENT DOCUMENTS 3,888,246 A * 6/1975 Lauer ..... A41D 13/1115 128/201.17
4,300,549 A * 11/1981 Parker ..... A41D 13/1115 128/206.19

(Continued)

FOREIGN PATENT DOCUMENTS

CN 102292128 A 12/2011
CN 103169174 A 6/2013

(Continued)

*Primary Examiner* — Colin W Stuart
(74) *Attorney, Agent, or Firm* — ScienBiziP, P.C.

(57) ABSTRACT

The present disclosure provides a respiratory protection device made of soft material comprising folds in zig-zag pattern on the main body and may be adhered to wearer's face by adhesives instead of straps. The respiratory protection device with folds is expandable from flat-fold configuration to open ready-to-use configuration, collapsible from the open ready-to-use configuration to the flat-fold configuration, and flexible to keep adhered to wearer's face when the respiratory protection device is dragged in conjunction with the movement of the wearer's face. The folding structures not only reduce the storage volume but also support the main body of the respiratory protection device to provide large air chamber for breathing comfortably in a completely sealed space. The present disclosure also provides a process of manufacturing the respiratory protection device by folding and fixing barrier layers and applying adhesives on the barrier layers.

55 Claims, 16 Drawing Sheets

(52) U.S. Cl.
CPC ..... *A41D 13/1169* (2013.01); *A41D 13/1176* (2013.01); *A62B 23/02* (2013.01); *A62B 23/025* (2013.01)

(58) Field of Classification Search
CPC ..... A41D 13/1115; A41D 13/1123; A41D 13/113; A41D 13/1138; A41D 13/1161; A41D 13/1169; A41D 13/1176
See application file for complete search history.

(56) References Cited

U.S. PATENT DOCUMENTS

| | | | | |
|---|---|---|---|---|
| 6,354,296 | B1 * | 3/2002 | Baumann | A41D 13/11 128/206.14 |
| 7,036,507 | B2 | 5/2006 | Jensen | |
| 2004/0089304 | A1 * | 5/2004 | Barakat | A41D 13/1115 128/206.12 |
| 2007/0023046 | A1 * | 2/2007 | Huang | A41D 13/1161 128/206.12 |
| 2007/0175477 | A1 * | 8/2007 | Baggett | A41D 13/113 128/206.13 |
| 2010/0154806 | A1 * | 6/2010 | Duffy | A41D 13/1115 128/863 |
| 2011/0061656 | A1 * | 3/2011 | Matich | A62B 23/025 128/206.25 |
| 2012/0199142 | A1 * | 8/2012 | Nagao | A41D 13/1115 128/863 |
| 2013/0037032 | A1 * | 2/2013 | Shibata | A62B 23/025 128/206.19 |
| 2014/0034059 | A1 * | 2/2014 | Yagi | A61M 16/06 128/207.11 |
| 2014/0326245 | A1 | 11/2014 | Teng | |
| 2017/0360125 | A1 * | 12/2017 | Tuan | A41D 13/1115 |
| 2017/0367416 | A1 * | 12/2017 | Yamada | B01J 20/06 |

FOREIGN PATENT DOCUMENTS

| | | | |
|---|---|---|---|
| CN | 204467009 | U | 7/2015 |
| CN | 206260898 | U | 6/2017 |
| JP | 2012-512704 | A | 6/2012 |
| KR | 10-2016-0048181 | A | 5/2016 |
| TW | M491485 | U | 12/2014 |
| TW | M512416 | U | 11/2015 |
| TW | M522041 | U | 5/2016 |

* cited by examiner

RESPIRATORY PROTECTION DEVICE AND PROCESSES FOR PRODUCING THE SAME

CROSS-REFERENCE TO RELATED APPLICATION

The present application claims priority to PCT International Application No. PCT/CN2017/097787, filed on Aug. 17, 2017, which claims the benefit of U.S. Provisional Patent Application No. 62/375,909, filed on Aug. 17, 2016, the entirety of which are incorporated herein by reference.

FIELD

The present disclosure generally relates to a respiratory protection device capable of adhering to a user's face without straps, forming a bowl-shaped air chamber during use and becoming flat folded when packaged.

BACKGROUND

Respiratory protection devices are worn over the breathing passage of a wearer for preventing environmental impurities, contaminants or pathogens from entering user's breathing track. For example, people live in an air-polluted environment use respiratory protection devices to prevent inhaling harmful suspended particles and to protect the facial skin exposed to the air. Respiratory protection devices may also be used to block the air flow from wearer's breathing. For example, patients may use respiratory protection devices to prevent spreading pathogens, or people working in an operating room or clean room may use respiratory protection devices to keep the saliva particles from the environment.

Traditional respiratory protection devices are positioned on wearer's face by one or more harness straps for ears or head. However, the straps may not keep the masks seamlessly attached to the user's face for sufficient filtration and also may bring uncomfortable pressure to the wearer. When receiving tension from harness straps, the masks made of a flexible material are deformed and leave space at the periphery. The masks made of a rigid material may maintain its shape under tension, but the rigid masks may not fit everyone's face and will leave spaces, too. The unfiltered, polluted air is easily inhaled through the spaces. On the other hand, harness straps that come in one size may bring pain to some wearers' ears or head, and may lower user's willingness to use the masks.

Some accessories on the masks may help to isolate the unfiltered air. For example, sponge or other soft materials set on the mask periphery and metal piece on the nose bridge may augment the sealing engagement between the masks and the wearers' faces. But addition of the accessories increases the complexity and cost in manufacturing. The accessories may also increase the package volume of the masks.

The present disclosure provides a respiratory protection device made of soft materials comprising folds in zig-zag pattern on the main body and may adhere to wearer's face by adhesives instead of straps. The respiratory protection device with folds is expandable to transit from flat-fold configuration to open ready-to-use configuration, collapsible to transit from open ready-to-use configuration to flat-fold configuration, and flexible to keep adhered to wearer's face when the respiratory protection device is dragged in conjunction with the movement of wearer's face. The folding structures may not only reduce the storage volume but also support the main body of the respiratory protection device to provide large air chamber for breathing comfortably with a completely sealed space filled with filtered clean air. The present disclosure also provides a process of manufacturing the respiratory protection device by folding and fixing barrier layers and applying adhesive on the barrier layers.

BRIEF DESCRIPTION OF THE DRAWINGS

An embodiment of the present disclosure is described with reference to the accompanying drawings, in which.

DETAILED DESCRIPTION

Figure 1:
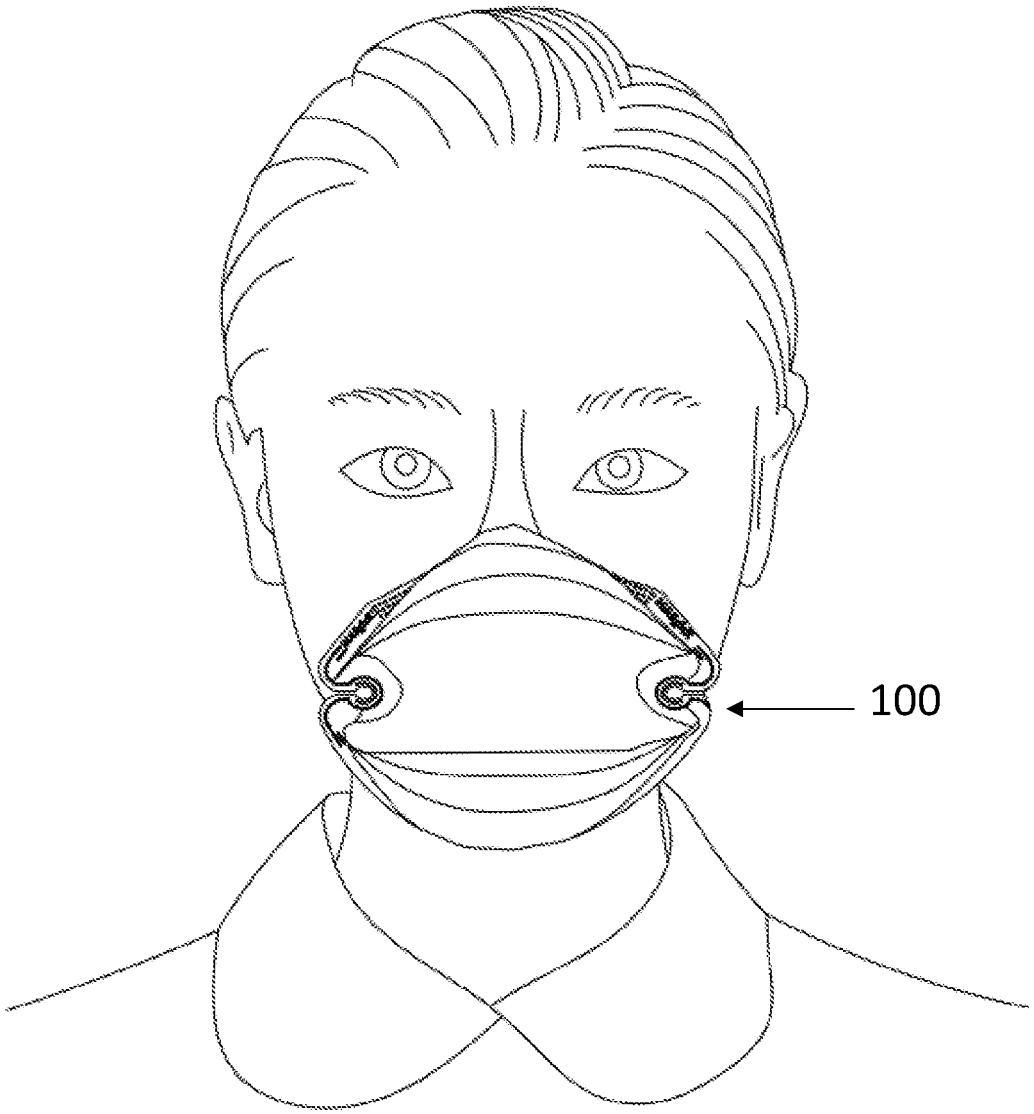
FIG. 1 illustrates a respiratory protection device with no straps positioned on the face of the user according to one embodiment of the present disclosure.

In one embodiment of the present disclosure as shown in FIG. 1, a respiratory protection device with no straps 100 in open ready-to-use configuration forms a bowl-shaped air-chamber over the mouth and nose of a user and adheres to user's face at the periphery of the respiratory protection device bringing the respiratory protection device in sealing engagement with the user. The present disclosure may also be a respiratory protection device such as a surgical mask, a clean room mask, a dust mask, a breath warming mask, a face shield, and a variety of face coverings according to some embodiments of the present disclosure.

Figure 2:
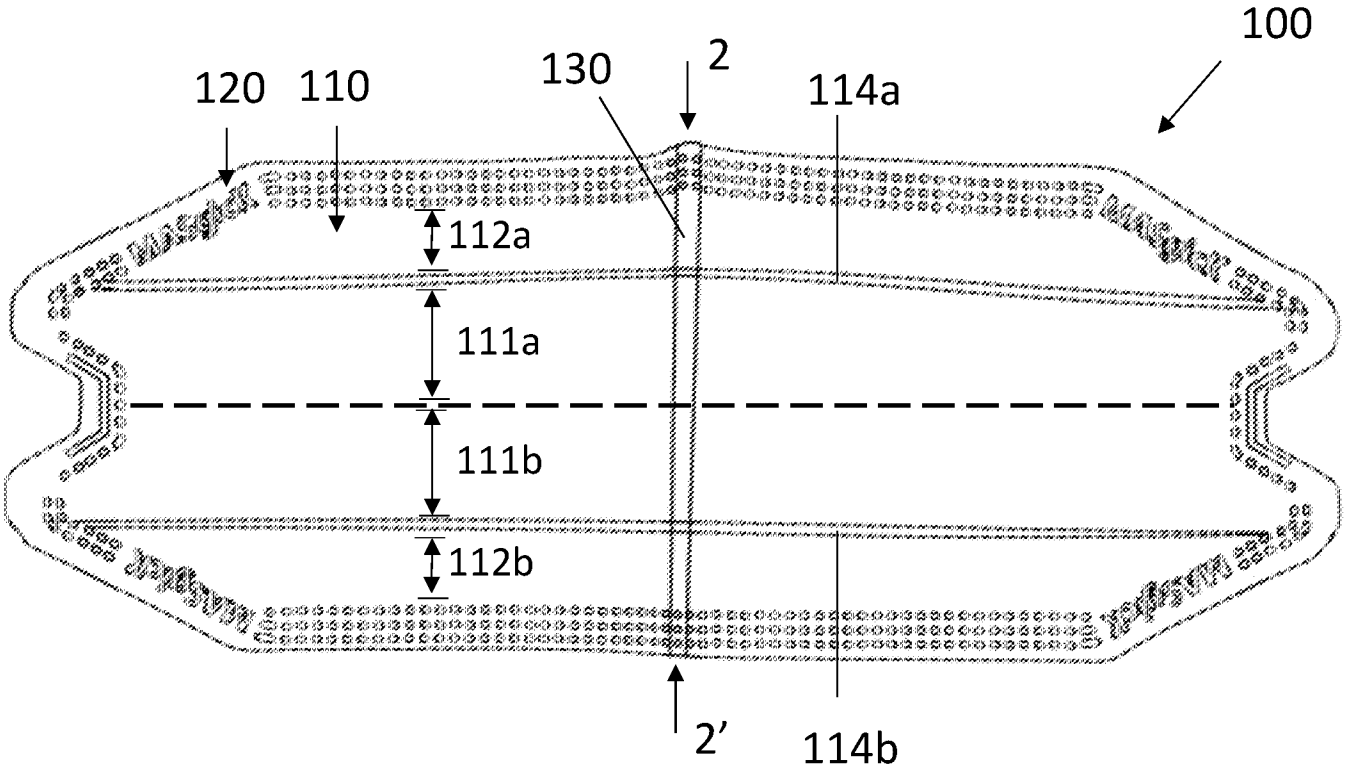
FIG. 2 illustrates a front view of an expandable respiratory protection device with no straps in flat-fold configuration according to one embodiment of the present disclosure.
Figure 3:
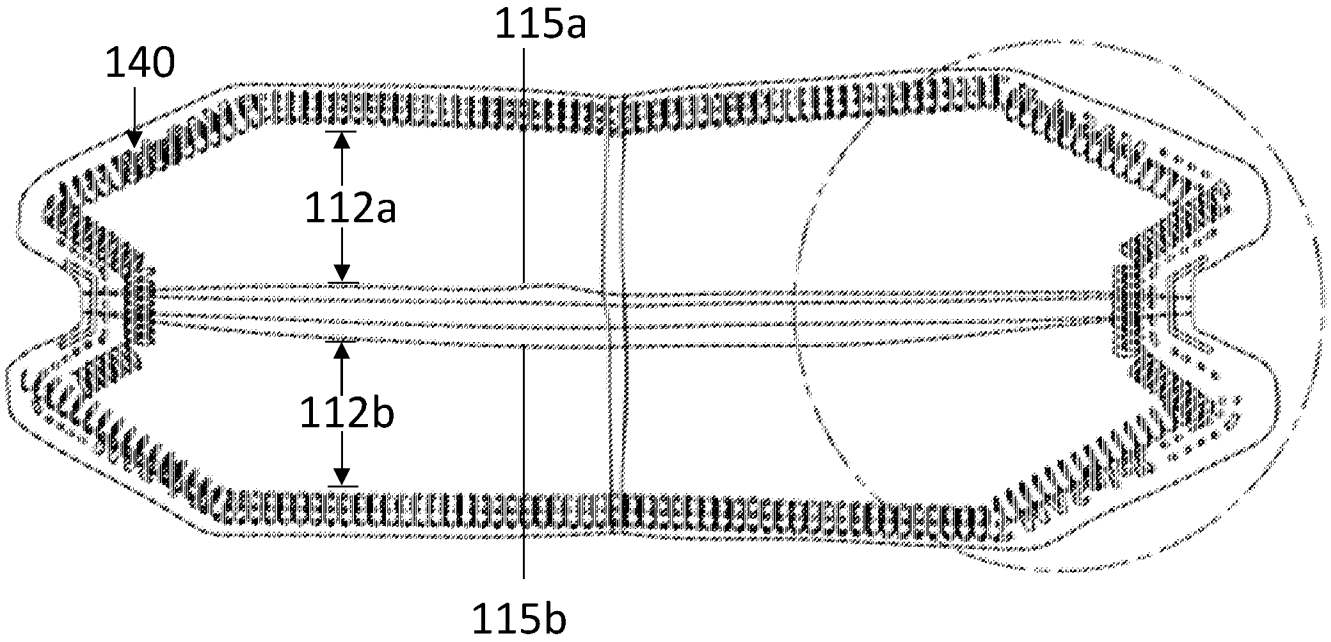
FIG. 3 illustrates a rear view of an expandable respiratory protection device with no straps in flat-fold configuration according to one embodiment of the present disclosure.

In one embodiment of the present disclosure as shown in FIGS. 2 and 3, a front view and a rear view of an expandable respiratory protection device with no straps 100 in flat-fold configuration may comprise a main body 110 in a flattened state, a sealing periphery 120 surrounds the main body 110, a central fold 130 and adhesive 140 substantially on the rear side of the sealing periphery 120. The main body 110 may further comprise a pair of top panels (first top panel 111*a* and second top panels 111*b*), a pair of bottom panels (first bottom panel 112*a* and second bottom panel 112*b*), and at least a pair of intermediate panels (not shown) between the top panels 111*a*, 111*b* and bottom panels 112*a*, 112*b*. Two of aforementioned panels (including top panels 111*a*, 111*b*, intermediate panels and bottom panels 112*a*, 112*b*) may be joined together by respective long side to compose a fold which comprises a folding line and an approximate area, which is substantially respective sides of the adjacent panels, along the folding line. In some implementations, each pair of the aforementioned adjacent panels may be formed as one piece but separated by a fold, and in other implementations, each pair of the aforementioned adjacent panels may further be joined through a seam, a weld or a bond. Referring to FIGS. 2 and 3 again, the folds with folding line on the side away from the center of the respiratory protection device and protruding outward are denoted as mountain folds 114*a* and 114*b*. The folds with folding line on the side near the center of the respiratory protection device and denting inward are denoted as valley folds 115*a* and 115*b*. In one embodiment of the present disclosure, the two top panels 111*a* and 111*b*, which are the uppermost panels, may be joined in parallel by respective long sides so that the two top panels 111*a* and 111*b* are located on opposite sides of an transverse axis (shown as a dash line) defined by the two ends of the long side connecting the uppermost panels of the first set and the second set. In some implementations, the top panels 111*a* and 111*b* may further be manufactured in one piece. In one embodiment of the present disclosure, the top panels 111*a* and 111*b* may respectively join the adjacent top one of a plurality of intermediate panels through mountain folds 114*a* and 114*b*. The bottom panels 112*a* and 112*b* may respectively join the adjacent bottom one of a plurality of intermediate panels through valley folds 115*a* and 115*b*.

Figure 4:
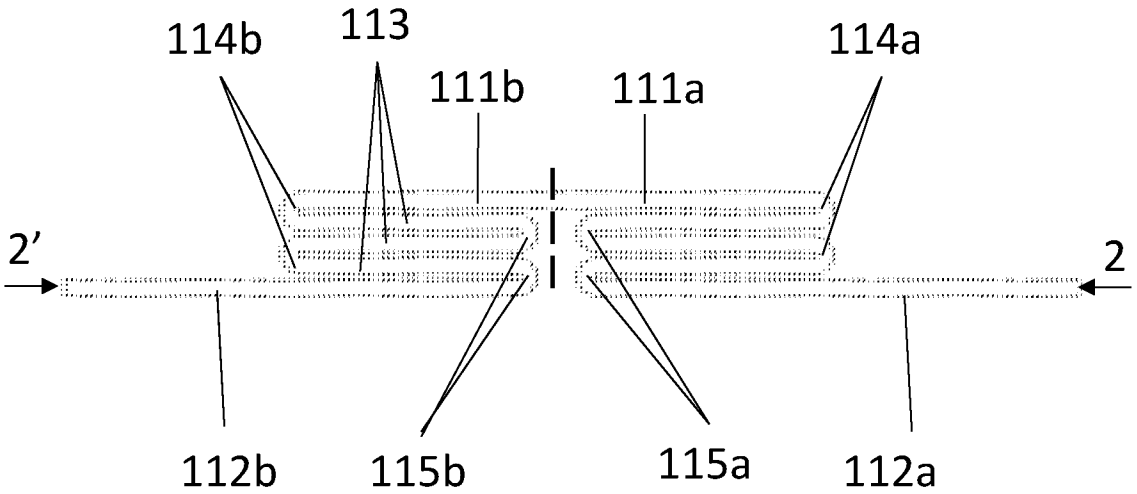
FIG. 4 illustrates a cross-section taken along line 2-2' of an expandable respiratory protection device with no straps in flat-fold configuration shown in FIG. 2 according to one embodiment of the present disclosure.

In one embodiment of the present disclosure as shown in FIG. 4, a cross-section of the respiratory protection device in flat-fold configuration taken along line 2-2', shows a first set of stacked panels and a second set of stacked panels comprised of the expandable respiratory protection device. Each of the first set and the second set comprises a top panel 111, one or more intermediate panels 113 and a bottom panel 112 joined one by one at long sides in a zig-zag pattern and are fixed together at two short sides. One of the long sides of an uppermost panel, the top panel 111*a*, of the first set merges with one of the long sides of an uppermost panel, the top panel 111*b*, of the second set so that the first set and the second set are located on opposite sides of the transverse axis defined by the two ends of the long side connecting the uppermost panels of the first set and the second set. The first set of stacked panels together forms the first half of main body 110, and the second set of stacked panels together forms the second half of main body 110. The top panels 111*a* and 111*b* may respectively join the adjacent top one of a plurality of intermediate panels 113 though mountain folds 114*a* and 114*b*. The bottom panels 112*a* and 112*b* may respectively join the adjacent bottom one of a plurality of intermediate panels 113 through valley folds 115*a* and 115*b*. Each of the intermediate panels 113 may join another adjacent intermediate panels 113 one by one through either mountain folds 114 or valley folds 115. In some implementations, the zig-zag patterns of the two sets of stacked panels are substantially symmetrical to each other. The numbers of panels in both sets with symmetrical zig-zag pattern are the same. Two panels at corresponding position in two respective sets of stacked panels with symmetrical zig-zag pattern are substantially in the same shape and area. A configuration of the mountain folds 114 and the valley folds 115 of the first half body is substantially symmetrical to a configuration of the mountain folds 114 and the valley folds 115 of the second half body. In one embodiment of the present disclosure, the top panels 111*a* and 111*b* and the intermediate panels 113 may be substantially equal in area. In one embodiment of the present disclosure, the top panels 111*a* and 111*b* and the intermediate panels 113 may be smaller than bottom panels 112*a* and 112*b* in area for forming specific shapes of air chamber in ready-to-use configuration. In some implementations, the top panels 111*a* and 111*b*, the intermediate panels 113 and the bottom panels 112*a* and 112*b* may further be different in area, such as gradually reduced in area from the bottom panels 112*a* and 112*b*, through the intermediate panels 113, to the top panels 111*a* and 111*b*. In some implementations, the number of intermediate panels 113 between the first top panel 111*a* and the first top panel 112*a* may be larger or smaller than the number of intermediate panels 113 between the second top panel 111*b* and the second bottom panel 112*b* for forming specific shapes of air chamber in ready-to-use configuration.

Figure 5:
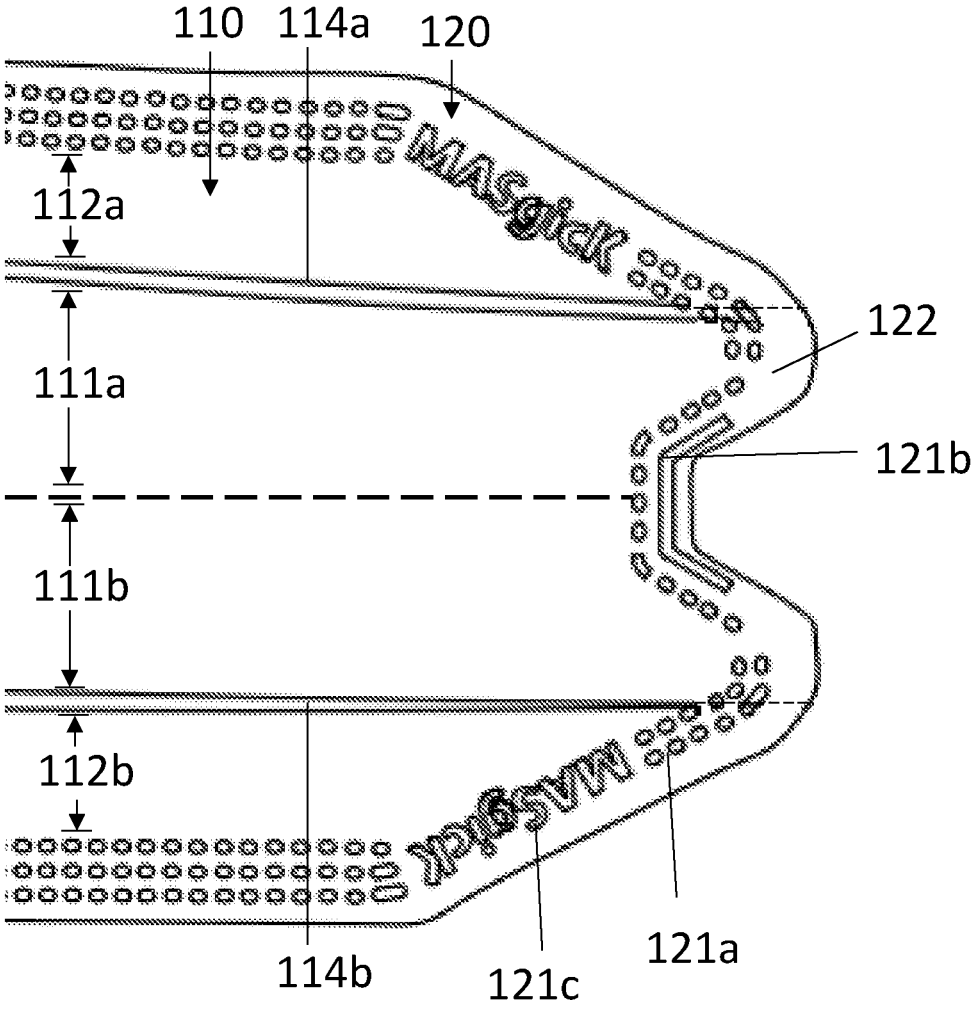
FIG. 5 illustrate an enlarged front view in part of an expandable respiratory protection device with no straps in flat-fold configuration according to one embodiment of the present disclosure.
Figure 6:
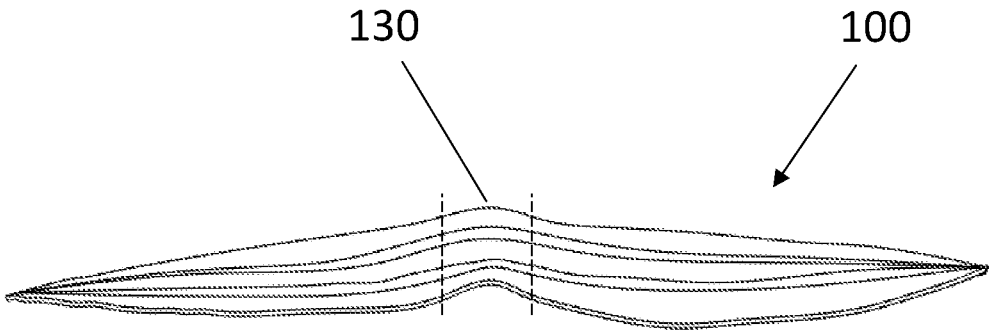
FIG. 6 illustrates a side view from the length of an expandable respiratory protection device with no straps in flat-fold configuration according to one embodiment of the present disclosure.

Referring to FIGS. 5 and 6, the sealing periphery 120 may contain edge seals 121 and may surround the main body 110. In one embodiment of present disclosure, the edge seals may be surface indentations in any configuration to compress and fix multi-layers of sheets forming main body 110 together. In some implantations, the sealing periphery 120 may be 1-15 mm in width and may be especially 8 mm in width for better sealing effect and not compressing the room for air chamber in ready-to-use configuration. In one embodiment of present disclosure, the edge seals 121 may be in the form of dots 121*a*, lines 121*b* and texts 121*c* each providing different strength of sealing and different softness while attaching to a user's face. In some implementations, the edge seals may be in the form of two-dimensional figures. The sealing periphery 120 may comprise two fold-gathering regions 122 on corresponding lateral sides of the respiratory protection device 100. Each of the fold-gathering regions 122 on corresponding sides may be respectively defined by the union of respective part of sealing periphery 120 receiving mountain folds 114 and valley folds 115. The fold-gathering regions 122 may seal a plurality of fold 114 and 115 and a plurality of panels 111, 112 and 113 at short sides. Therefore, by moving the fold-gathering regions 122 toward each other, the panels 111, 112 and 113 and the folds 114 and 115 may bend and form the air chamber in ready-to-use configuration accordingly.

In one embodiment of the present disclosure, the respiratory protection device 100 comprising a first half body and a second half body substantially in a plane shape. Each of the first and second half bodies comprises a plurality of mountain folds 114 protruding outward, a plurality of valley folds 115 denting inward, and a periphery 120 surrounding the half body. The mountain folds 114 and the valley folds 115 are substantially parallel and arranged alternatingly. The periphery 120 comprises two fold-gathering regions 122 and the folds are closed and fixed at the fold-gathering regions. The first half body and the second half body are joined by a side so that the first half body and the second half body are located on opposite sides of a transverse axis defined by two ends of the side connecting the first half body and the second half body.

In one embodiment of present disclosure, the edge seals in the form of lines 121*b* may provide higher sealing strength and hardness than edge seals in the form of dots 121*a* do. A combination of different forms and number of edge seals 121 (such as combinations of edge seals 121*a*, 121*b* and 121*c*) may be included in specific parts of sealing periphery 120 such as the fold-gathering regions 122 which bear large force during transition of the respiratory protection device 100 between ready-to-use configuration and flat-fold configuration.

Figure 16:
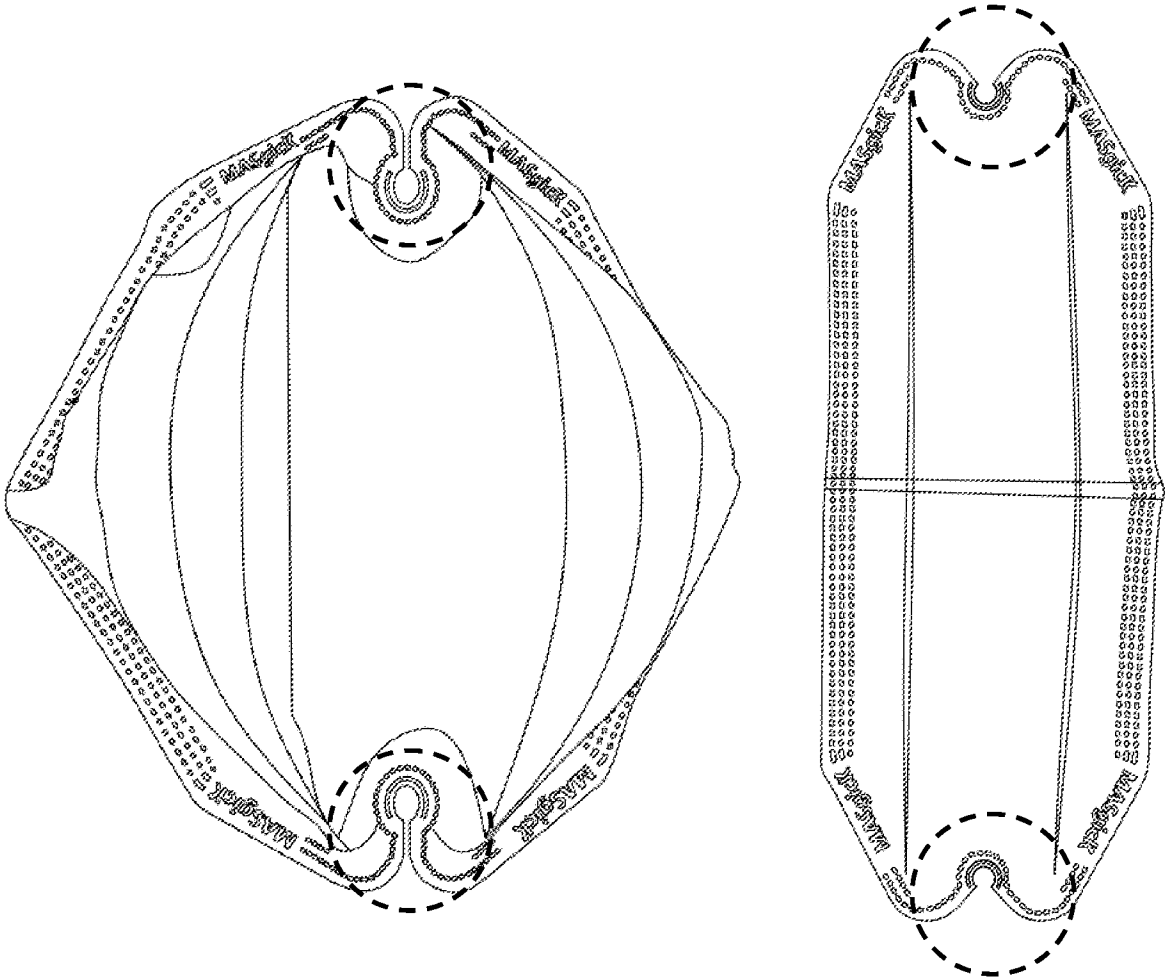
FIG. 16 illustrates concave notches in a form of key-hole according to one embodiment of the present disclosure.

In one embodiment of present disclosure, the fold-gathering regions 122 on the adjacent short sides may form two concave notches leaving space beside the respiratory protection device 100 for the panels 111, 112 and 113 and folds 114 and 115 moving during transition of the respiratory protection device 100. The presence of space prevents the fold-gathering regions 122 from bending outward or inward and leaving air pathway between the respiratory protection device 100 and the wearer. In some implementations, the concave notches leave space in form of a trapezoid, a triangle or a semicircle. In some implementations, the concave notches each comprises a pair of straight lines joined by a curved line. The two lines become closer to each other during transition and may be parallel when the transition is done. The curved line bends and prevents forming discomforting sharp structure on the respiratory protection device 100 during transition. In some implementations, the concave notches each comprising two straight lines joined by one curved line may be in form of a key-hole, as shown in dash line in FIG. 16.

In one embodiment of present disclosure, referring to FIGS. 2 and 6, the central fold 130 may be defined by a fold for folding the respiratory protection device 100 in substantial half and the curved structure nearby the fold referring to FIG. 6. The central fold 130 may be substantially perpendicular to the transverse axis and parallel to a vertical axis defined by centers of the side connecting the first half body and the second half body. The central fold 130 may be substantially perpendicular to the transverse axis and parallel to a vertical axis defined by centers of the long sides of the first set of panel and the second set of panel. The central fold 130 may cross all the plurality of panels and folds. The central fold 130 may be a positioning reference to user's face while in use.

Figure 7:
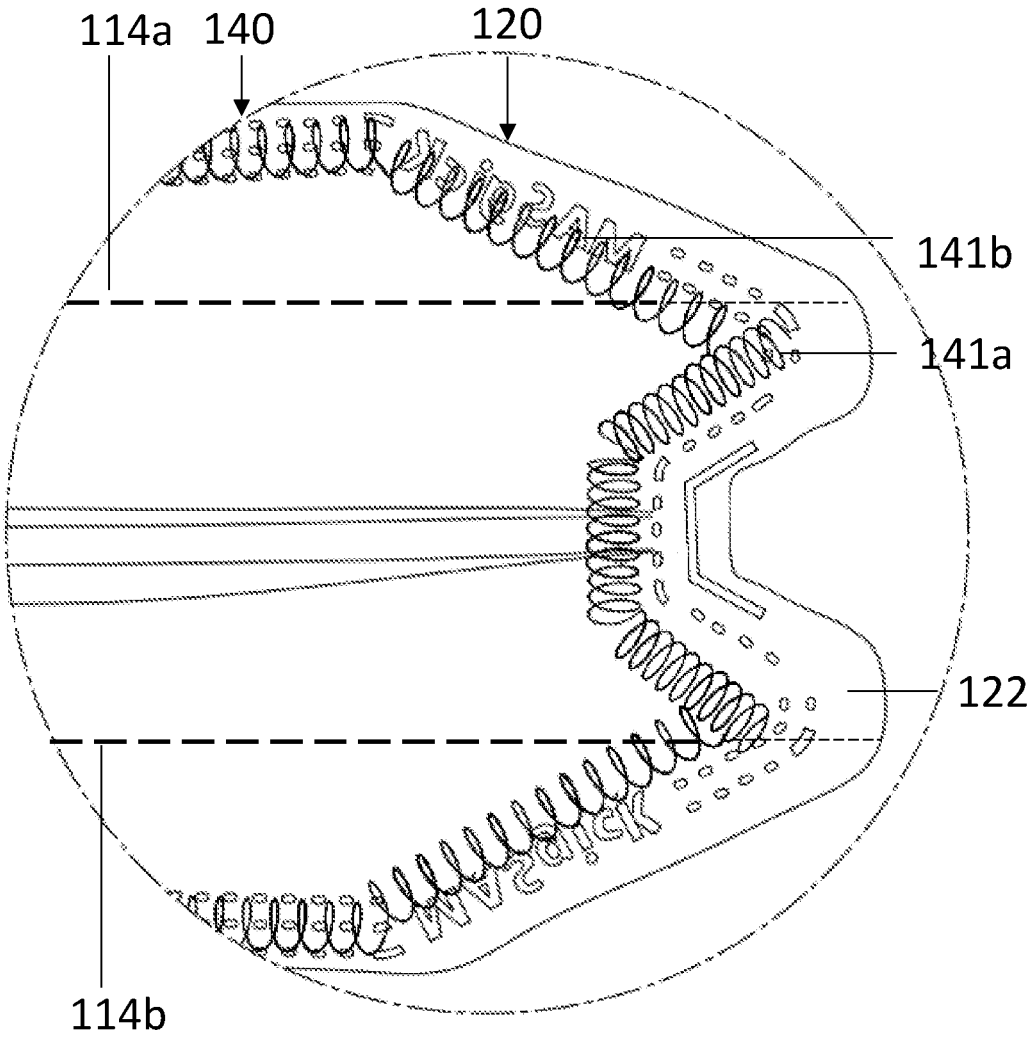
FIG. 7 illustrate an enlarged rear view in part of an expandable respiratory protection device with no straps in flat-fold configuration according to one embodiment of the present disclosure.

In one embodiment of the present disclosure as shown in FIGS. 3 and 7, the adhesive 140 may be distributed on the lowermost panels along the outer edge of the respiratory protection device 100 bringing the respiratory protection device 100 in sealing engagement with the user. In some implementations, the adhesive 140 comprising two portions located apart from each other on the respiratory protection device 100 for adhering the respiratory protection device 100 to two sides on user's face. In some implementations, the adhesive 140 may be a substantially continuous sealing layer distributed on substantially an entire edge of the respiratory protection device 100 for sealing substantially an entire edge of the air chamber of the respiratory protection device 100 in open ready-to-use configuration. The width of the adhesive 140 may vary and the adhesive strength may positively correlate to the width of the layer 140. The adhesive 140 may provide enough adhesive strength with a minimum width and may provide least space for forming an air chamber with a maximum width. The width of the adhesive 140 may not diminish the volume of air chamber to an extent which hinders user's breathing. In one embodiment of the present disclosure, the width of the adhesive 140 may be close to the width of the sealing periphery 120. In some implementations, the adhesive 140 may be 1-15 mm in width and may be especially 8 mm in width based on the width of the sealing periphery 120.

The glutinous material may be distributed onto the respiratory protection device 100 in kinds of track which may affect the adhesion strength and surface structure of the adhesive 140. The glutinous material may be distributed in a non-linear track substantially along the edge of the respiratory protection device 100. The non-linear track may include curves and turns and may further be an uncrossed non-linear track, such as a serrated track, or a crossed non-linear track including one or more crossed points on the track, such as a helical track 141*a* and 141*b* as shown in FIG. 7. The glutinous material at crossed points on the crossed non-linear track may be thicker than the nearby structure.

Adhesion strength of the adhesive 140 may be stronger with a thicker or a wider layer. The topology of crossed non-linear distributing track or the discharging quantity of the glutinous material may affect the thickness of the adhesive 140. For example, referring to FIG. 7, a compact helical distributing track 141*a* of the glutinous material may include more crossed points and corresponding thicker structures therefore giving stronger adhesive strength. In one embodiment of present disclosure, an amount of the adhesive distributed on a portion of the outer edge of the respiratory protection device 100 is higher than an amount of the adhesive distributed on another portion of the outer edge. In some implementations, the compact helical distributing track 141*a* may be on the rear sides of two fold-gathering regions 122 to give a stronger adhesive strength than the loosen helical distributing track 141*b* on the rear side of remaining regions of the sealing periphery 120. In some implementations, the thicker adhesive may be in the regions contacting more skin secretions, such as regions contacting with the skin of the nose.

The surface of the adhesive 140 formed by a non-linear distributing track or by a distributing track with varying discharging quantity may be relatively uneven to the surface of the adhesive 140 formed by a linear distributing track with constant discharging quantity. For example, the helical distributing track 141*a* and 141*b* of the glutinous material shown in FIGS. 3 and 7 may result in the uneven surface of the adhesive 140. The uneven surface of the adhesive 140 may leave space for discharging secretions, such as air and liquid, from skin while providing enough adhesion strength.

In some implementations, the adhesive 140 may be a pressure sensitive adhesives possessing certain properties including the following: (1) permanent tack, (2) adherence with no higher than finger pressure, (3) sufficient ability to hold onto the skin, and (4) sufficient cohesive strength. The glutinous material may be polymers providing appropriate adhesion strength between the respiratory protection device and user's skin, such as various (meth) acrylate based copolymers, naturel rubbers, synthetic rubbers, and silicones. The glutinous material may be removable from user's skin. In one embodiment of present disclosure, the glutinous material may be a material whose glutinousness may positively relate to the temperature for providing high adhesiveness while attaching to skin of users in open ready-to-use configuration.

Figure 8:
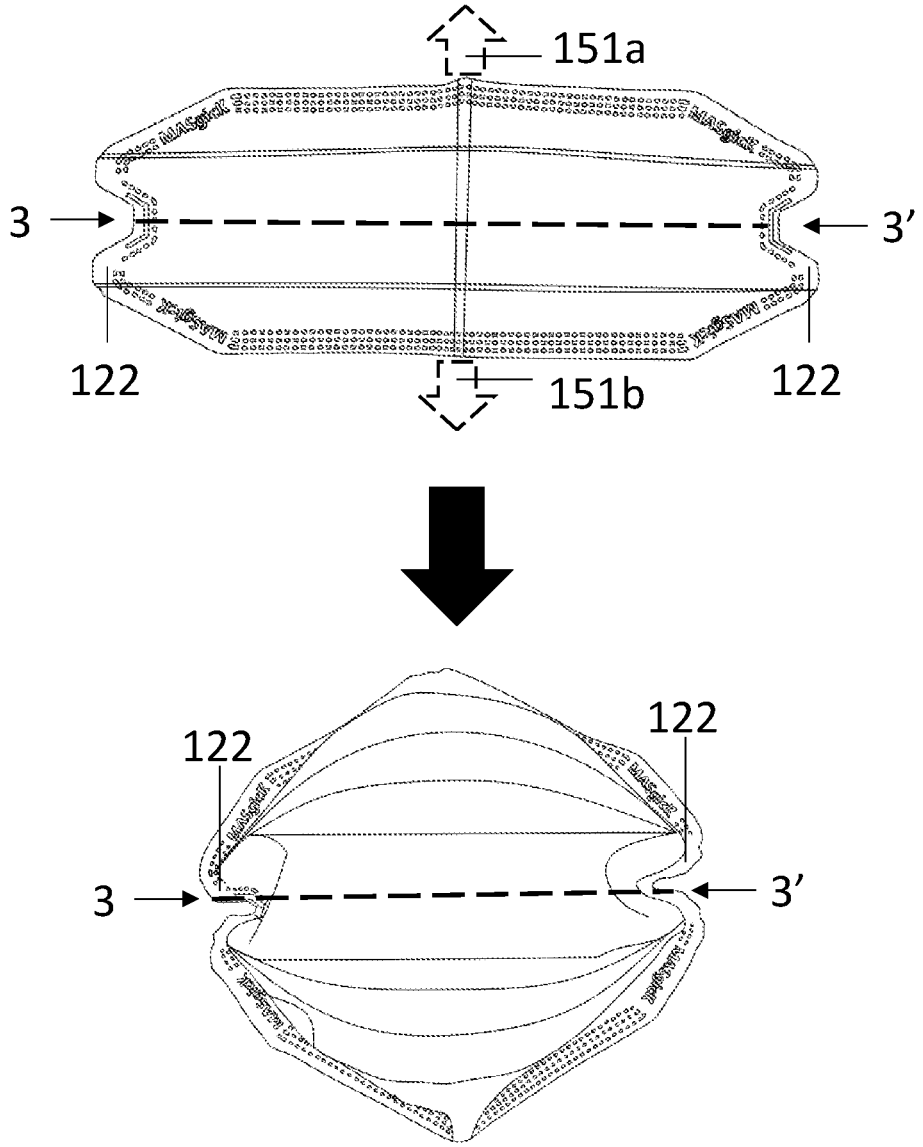
FIG. 8 illustrate a transition of an expandable respiratory protection device with no straps from flat-fold configuration to open ready-to-use configuration according to one embodiment of the present disclosure.

Referring to FIG. 8, there is a transition of a respiratory protection device with no straps 100 from flat-fold configuration to open ready-to-use configuration. The main body 110 transits from a flattened state to an arched state forming the air chamber. The respiratory protection device 100 in the flat-fold configuration may transit while the respective bottom panels 112*a* and 112*b* or the joining parts of sealing periphery 120 receiving two substantially antiparallel force 151*a* and 151*b* perpendicular to and away from the transverse axis and the folds 114 and 115, denoted as arrows in dash line. In the transition of the respiratory protection device 100, the bottom panels 112*a* and 112*b* may move along the directions of force 151*a* and 151*b* respectively and may pull a plurality of joined intermediate panels 113 outward. Centers of the panels 111, 112 and 113 move away from the transverse axis radially so that the panels 111, 112 and 113 unstack and become joined with each other angularly. The mountain folds 114 and valley folds 115 open and the centers of each mountain folds 114 and valley folds 115 move away from the transverse axis radially. The panels 111, 112 and 113 may gradually become unfolded at an angle in some degree. The central fold 130 may extend with the moving panels 111, 112 and 113 and may become arched. However, the panels 111, 112 and 113 and the folds 114 and 115 may be fixed at the fold-gathering regions 122, so the panels 111, 112 and 113 and the folds 114 and 115 may gradually become arched and may pull the fold-gathering regions 122 to move toward the middle of folds 114 and 115. The adjacent fold-gathering regions 122 of the first and second half bodies move toward each other so that the first half and the second half body become arched. Every point in the fold-gathering regions 122 may move toward the transverse plane 3-3' (shown as a dash line) which is extended from the joined edge of two top panels 111*a* and 111*b* and perpendicular to the top panels 111*a* and 111*b*, except for the points already on the transverse plane 3-3'. The arched panels 111, 112 and 113 may gradually form the dome-shaped main body 110 and the respiratory protection device 100 may transit to the open ready-to-use configuration.

Figure 9:
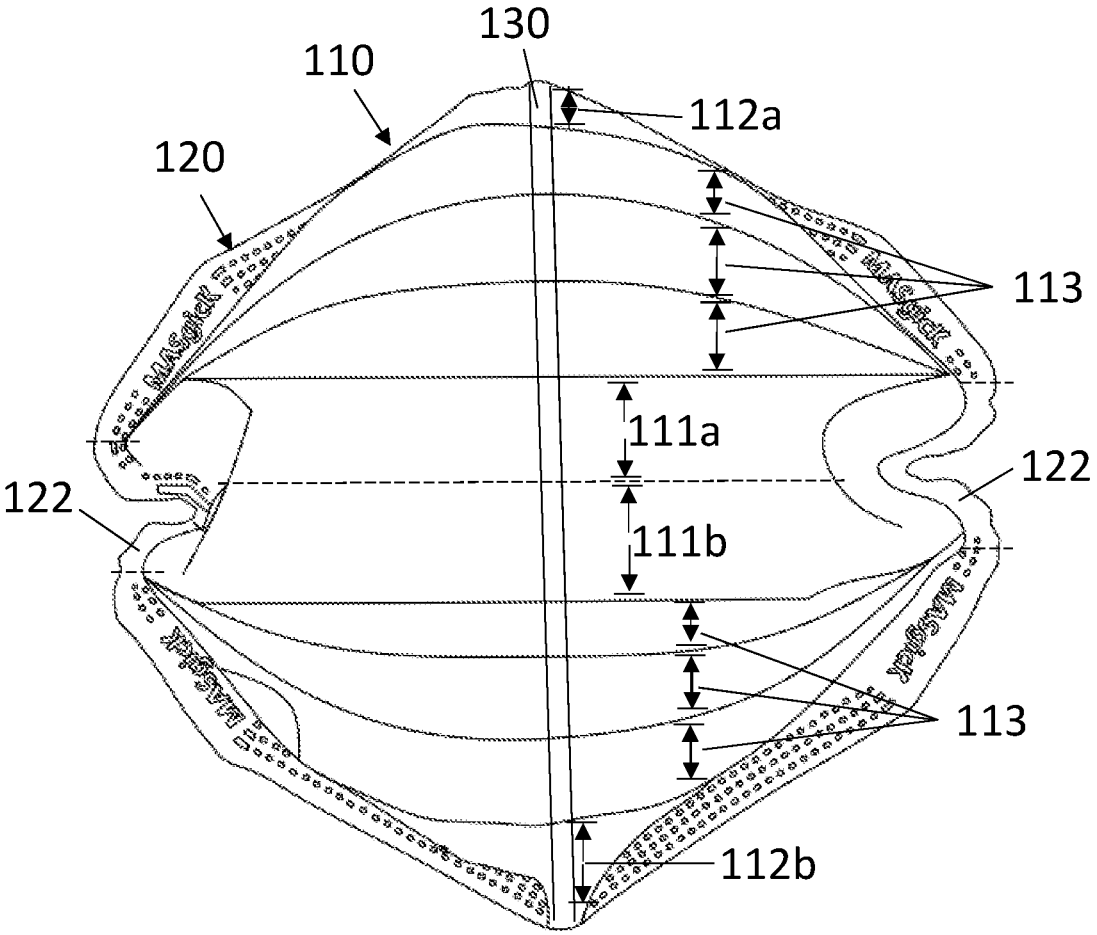
FIG. 9 illustrates a front view of a collapsible respiratory protection device with no straps in open ready-to-use configuration according to one embodiment of the present disclosure.
Figure 10:
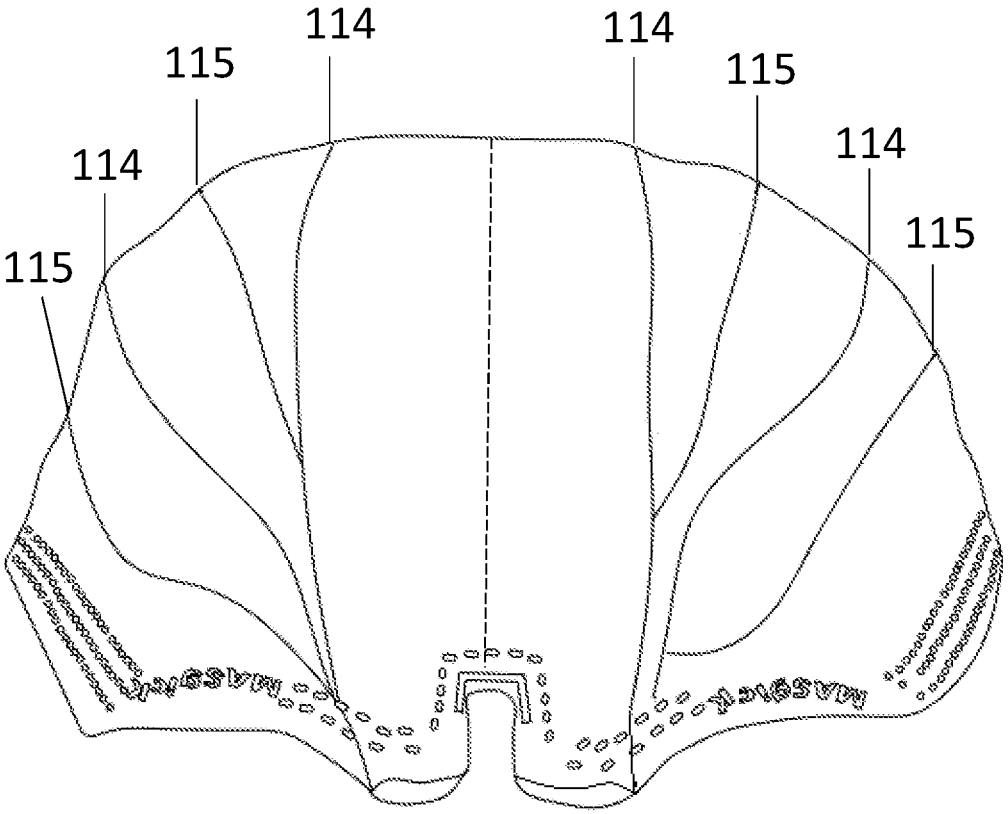
FIG. 10 illustrates a side view from the width of a collapsible respiratory protection device with no straps in open ready-to-use configuration according to one embodiment of the present disclosure.

In one embodiment of the present disclosure as shown in FIGS. 9-10, a front view and a side view of a collapsible respiratory protection device with no straps 100 in open ready-to-use configuration, each of the arched panels 111, 112 and 113 may join the adjacent panels at an angle in some degree without overlapping in most of the area. The arched panels 111, 112 and 113 can be viewed as a set of arched part. Two sets of arched parts form the collapsible respiratory protection device 100. The main body 110 is in an arched state. The curved central fold 130 together with the arched panels 111, 112 and 113 and arched folds 114 and 115 may give the dome-shaped main body 110 a shear strength for maintaining its shape. The arched panels 111, 112 and 113 and the arched folds 114 and 115 may be sealed at the respective fold-gathering regions 122 and may be arranged in a radial pattern with two radial centers in each fold-gathering region (referring to FIG. 10) playing the role of framework defining the dome-shaped main body 110 and the corresponding air chamber. The fold-gathering regions 122 may bend in response to the structural stress from the dome-shaped main body 110. In one embodiment of present disclosure, the concave notches formed by the fold-gathering regions 122 may give enough space for said fold-gathering regions 122 to bend inward and keep the whole sealing periphery 120 on a substantial plane without extrusion due to the bending. The sealing periphery 120 on a substantial plane may provide a better sealing engagement between the respiratory protection device 100 and the user. In some implementations, the fold-gathering regions 122 may also be in the form of a straight line or a convex line. The fold-gathering regions 122 in straight or convex line may bend to the front or to the rear during the open ready-to-use configuration transition.

Figure 11:
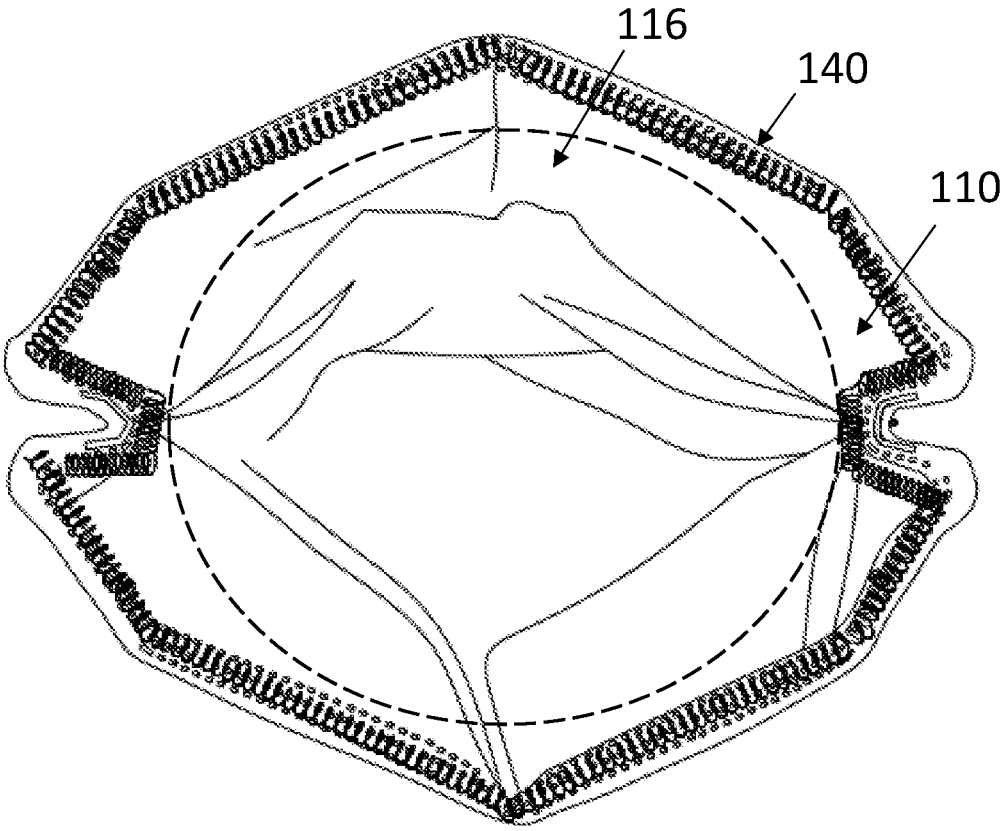
FIG. 11 illustrates a rear view of a collapsible respiratory protection device with no straps in open ready-to-use configuration according to one embodiment of the present disclosure.

In one embodiment of the present disclosure as shown in FIG. 11, a rear view of a collapsible respiratory protection device with no straps 100 in open ready-to-use configuration, a bowl-shaped air chamber 116 may be defined by the dome-shaped main body 110 and the adhesive 140. The bowl-shaped air chamber 116 may provide space for breathing and air exchange through the main body 110. In one embodiment of present disclosure, the bowl-shaped air chamber 116 may keep a constant volume during breathing due to the shear strength of the main body 110. In one embodiment of present disclosure, the adhesive 140 comprising a first portion and a second portion located apart from each other for adhering the respiratory protection device 100 to two sites on an object. When the two sites of the object move in respect to each other, the first set and the second set move in conjunction with movement of the two sites and at least one angle between two adjacent parts of the first and second sets changes so that the respiratory protection device 100 remains adhered to the object.

Figure 12:
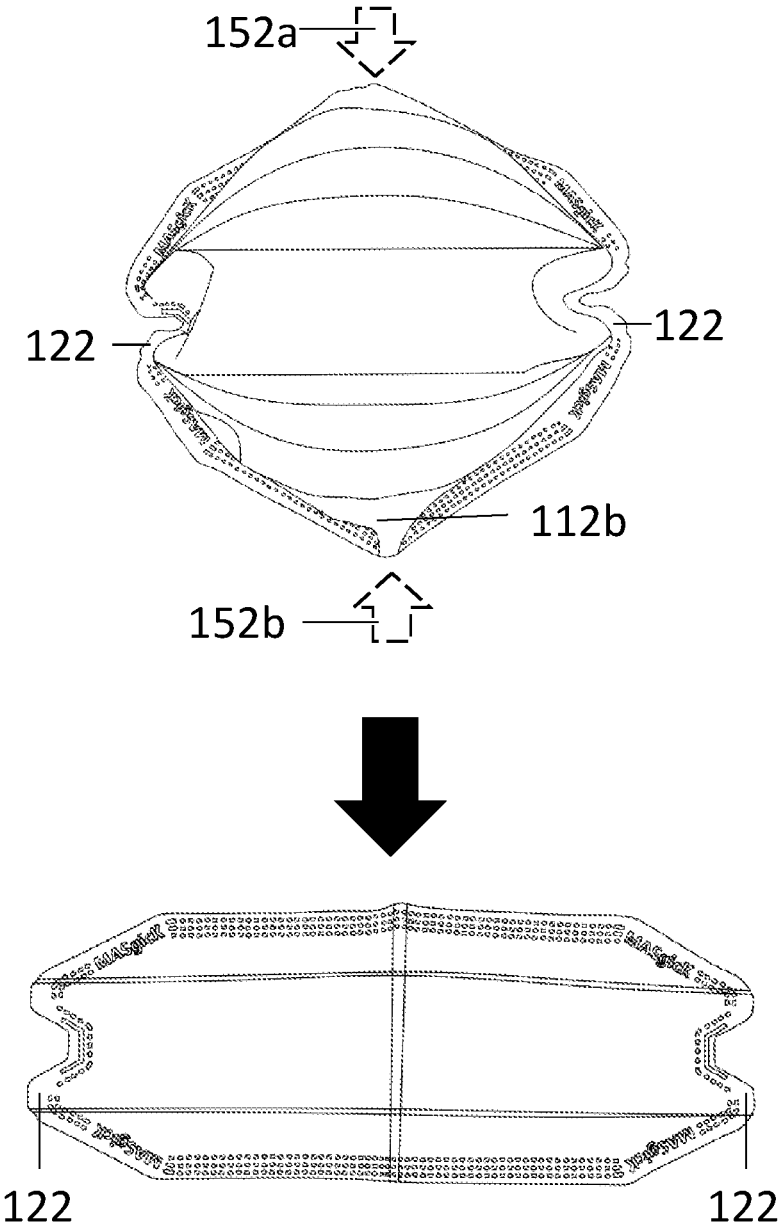
FIG. 12 illustrates a first transition of a collapsible respiratory protection device with no straps from arched state to flattened state according to one embodiment of the present disclosure.

Referring to FIG. 12, there is a first transition process of a collapsible respiratory protection device 100 from open ready-to-use configuration to flat-fold configuration. The main body 110 changes from an arched state to a flattened state. The respiratory protection device 100 in open ready-to-use configuration may change while the bottom panels 112*a* and 112*b* or the joining parts of sealing periphery 120 receiving two substantially antiparallel force perpendicular to and toward the folds 114 and 115, denoted as arrows in dash line. In the transition process of the respiratory protection device 100, the bottom panels 112*a* and 112*b* may move along the direction of force 151*a* and 151*b* respectively and may push a plurality of joined intermediate panels 113 inward. Centers of the panels 111, 112 and 113 and folds 114 and 115 move toward the transverse axis radially until the panels of the first and second sets stack in a zig-zag pattern. The two short sides and the two fold-gathering regions 122 of the first set and the second set move away from each other to cause the panels 111, 112 and 113 to be flattened. The angles comprised by panels 111, 112 and 113 may decrease to 0 degree and the panels 111, 112 and 113 may fold and overlapped. The respiratory protection device 100 may change into the aforementioned flat-fold configuration.

Figure 13:
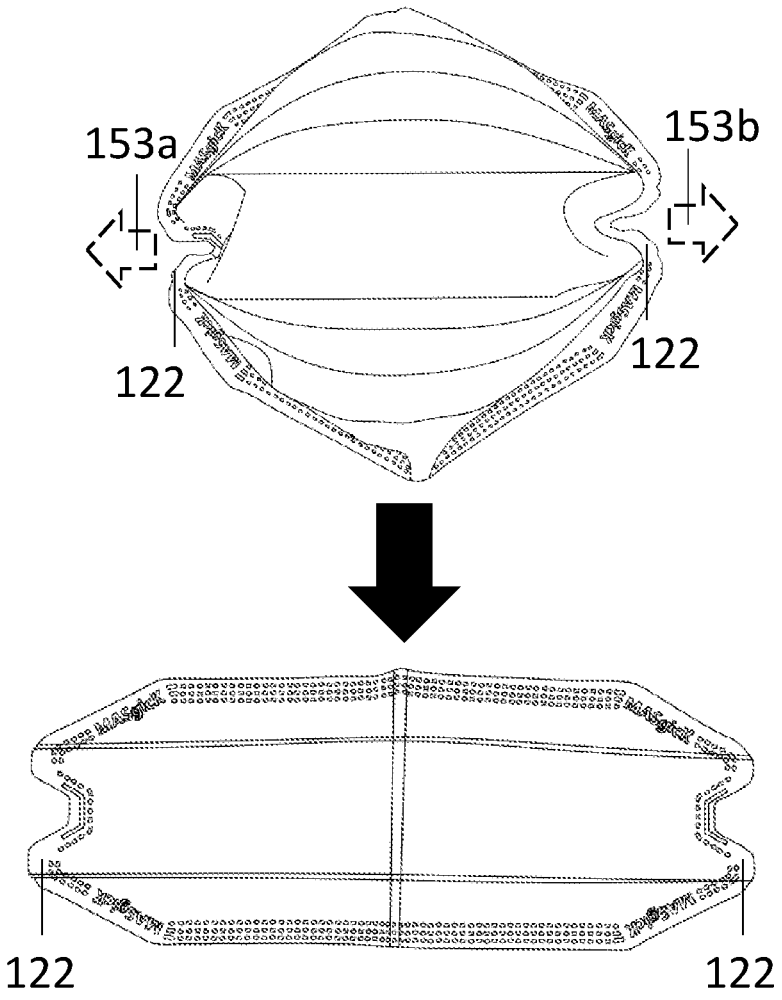
FIG. 13 illustrates a second transition of a collapsible respiratory protection device with no straps from arched state to flattened state according to one embodiment of the present disclosure.

Referring to FIG. 13, there is a second transition process of a collapsible respiratory protection device 100 from open ready-to-use configuration to flat-fold configuration. The main body 110 changes from an arched state to a flattened state. The respiratory protection device 100 in open ready-to-use configuration may change while the two fold-gathering regions 122 respectively receiving two substantially antiparallel force 153*a* and 153*b* away from the middle of folds 114 and 115 and parallel to the folds 114 and 115, denoted as arrows in dash line. In the transition of the respiratory protection device 100, the two fold-gathering regions 122 move away from each other to cause the panels 111, 112 and 113 to be flattened. Centers of the panels 111, 112 and 113 move toward the transverse axis radially until the panels of the first and second sets stack in a zig-zag pattern. The arched panels 111, 112 and 113 and arched folds 114 and 115 may be pulled by the fold-gathering regions 122 and gradually become flattened. The angles comprised by panels may decrease to 0 degree. The bottom panels 112*a* and 112*b* and a plurality of intermediate panels 113 may move toward the top panels 111*a* and 111*b* and may overlap with each other. The respiratory protection device 100 may change into the aforementioned flat-fold configuration.

Figure 14:
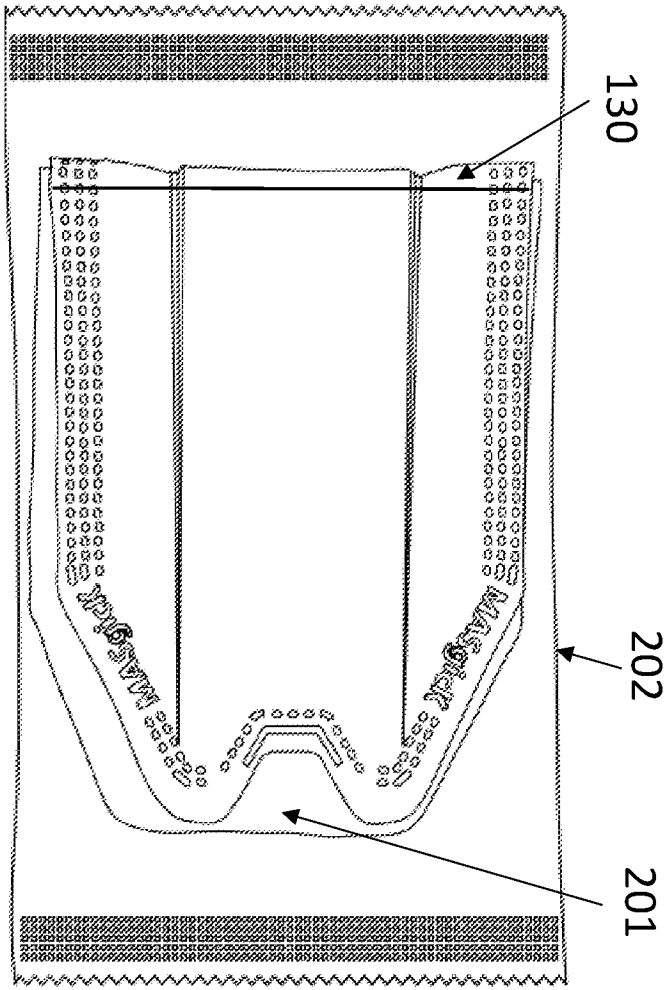
FIG. 14 illustrates an expandable respiratory protection device with no straps which is in half-fold configuration and is store in a container bag according to one embodiment of the present disclosure.

In one embodiment of the present disclosure as shown in FIG. 14, the respiratory protection device with no straps 100 in flat-fold configuration may be folded in half along the central fold 130 and may be stored in a container bag 202. The whole adhesive 140 may be covered by a releasing liner 201 having smooth surfaces (e.g. by polishing or coating with wax or silicone) for repeatable contact with adhesive 140. The releasing liner 201 with smooth surfaces may prevent adhesive 140 from adhering to each other or other inappropriate materials and may preserve the glutinousness of the adhesive 140 when the respiratory protection device is folded along the central fold. In one embodiment of present disclosure, a releasing liner 201 may be placed at the inner face of a substantial half-fold respiratory protection device 100 and may be clamped by the half-fold respiratory protection device 100. The container bag 202 may include space inside for storing one or more of half-fold respiratory protection device 100. In one embodiment of the present disclosure, the container bag 202 may comprise of soft materials. In some implementations, the soft container bag 202 may be a wrapper.

Figure 15:
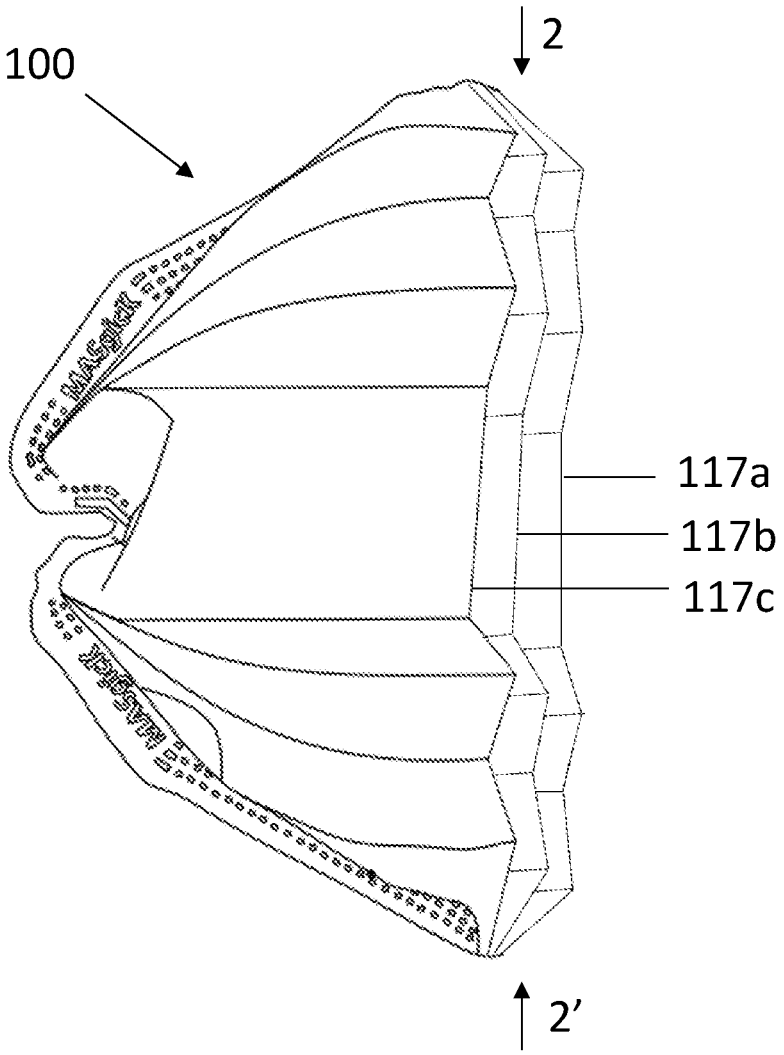
FIG. 15 illustrates a half of the collapsible respiratory protection device with no straps in open ready-to-use configuration dissected along line 2-2' according to one embodiment of the present disclosure.

Referring to FIG. 15, a half of the respiratory protection device with no straps 100 in open ready-to-use configuration dissected along line 2-2' is illustrated according to one embodiment of the present disclosure. The main body 110 of the respiratory protection device 100 may be made of soft materials. The soft materials may be comprised of one or more air permeable layers sealed at the periphery of the main body 110 by edge seals 121. The aforementioned layers may include one or more barrier layers that prevent the transfer of liquid, such as liquid aerosols or liquid splashes, from penetrating. The one or more barrier layers may also include a layer as a filter that blocks particles in specific size range (e.g. PM 2.5). The one or more barrier layers may further comprise a layer disposed with absorptive materials which may remove hazardous or odorous gases from the breathing air, such as activated carbon that may have been chemically treated, porous alumina-silica catalyst substrates and alumina particles. The one or more barrier layers may further comprise a water absorptive layer in some implementations. In one embodiment of the present disclosure, the respiratory protection device 100 may comprise three or more layers in equal area, an inner layer 117*a*, one or more intermediate layers 117*b* and an outer layer 117*c*. The inner layer 117*a* may comprise a skin-friendly surface (generally on the side toward user in ready-to-use configuration) for providing comfort to users while in ready-to-use configuration. The outer layer 117*c* may comprise a water-proof or hydrophobic surface for keeping the other layers dry while encountering water, especially in ready-to-use configuration. The intermediate layers 117*b* may include the aforementioned barrier layers having filtration and absorption capabilities. In some implementations, the intermediate filtration layers 117*b* may cover the whole area of main body 110 to filter all the gas passing through the main body 110, especially the region corresponding to the air chamber. In some implementations, one of the plurality of layers may be enlarged, such as an inner layer 117*a* enlarged and extended at the portion contacting user's nose.

In one embodiment of the present disclosure, a method for manufacturing the respiratory protection device 100 comprising: providing one barrier layer, forming a first set of zig-zag folds and a second set of zig-zag folds 114 and 115 on two opposite long sides of the barrier layer, closing and fixing two ends of the first set and the second set on two opposite short sides on the barrier layer, cutting the short sides of the barrier layer to form a concave notch on each of the short side and applying adhesive 140 on an outer edge of the barrier layer for allowing the respiratory protection device 100 to be adhered to an object. In some implementations, the adhesive 140 is applied along substantially all edge of the respiratory protection device 100. In some implementations, an amount of the adhesive 140 distributed on a portion of the outer edge of respiratory protection device 100 is higher than an amount of the adhesive 140 distributed on another portion of the outer edge. In some implementations, the adhesive 140 is applied along a non-linear track comprising one or more crossed points on the track. In some implementations, the short sides of the barrier layer are cut to form two concave notches leaving space beside the respiratory protection device 100. In some implementations, the respiratory protection device 100 is further folded in half so that the adhesive 140 faces an inner face side of the folded respiratory protection device and a releasing liner 201 is placed between the adhesive 140.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An expandable respiratory protection device, comprising:

a first set of stacked panels and a second set of stacked panels, wherein:

each of the first set and the second set comprises a plurality of panels joined one by one at two long sides of the plurality of panels in a zig-zag pattern and fixed together at two short sides on two ends of the long sides, one of the long sides of an uppermost panel of the first set merges with one of the long sides of an uppermost panel of the second set, such that the first set and the second set are located on opposite sides of a transverse axis defined by the two ends of the long sides connecting the uppermost panels of the first set and the second set, the adjacent short sides of the first set and the second set together form two concave notches, each of the two concave notches being at one of the two ends of the long sides, each of the two concave notches comprises a pair of straight lines joined by a curved line, and the expandable respiratory protection device expands and forms a chamber and each of the pair of straight lines moves closer to be parallel to each other when:

centers of the plurality of panels of the first set and the second set move away from the transverse axis radially, such that the plurality of panels unstack and join each other angularly, and the adjacent short sides of the plurality of panels move toward each other, such that the plurality of panels become arched.

2. The expandable respiratory protection device of claim 1, further comprising adhesive distributed on lowermost panels of the first set and the second set along an outer edge of the expandable respiratory protection device.

3. The expandable respiratory protection device of claim 2, wherein an amount of the adhesive distributed on a portion of the outer edge of the expandable respiratory protection device is higher than an amount of the adhesive distributed on another portion of the outer edge of the expandable respiratory protection device.

4. The expandable respiratory protection device of claim 2, wherein the adhesive comprises a pressure sensitive adhesive material.

5. The expandable respiratory protection device of claim 1, further comprising a sealing layer on lowermost panels of the first set and the second set, the sealing layer comprising adhesive for adhering an entire edge of the chamber formed by the expandable respiratory protection device to an object.

6. The expandable respiratory protection device of claim 1, further comprising a central fold perpendicular to the transverse axis and parallel to a vertical axis defined by centers of the long sides of all of the plurality of panels.

7. The expandable respiratory protection device of claim 1, wherein the zig-zag pattern of the first set of stacked panels is symmetrical to the zig-zag pattern of the second set of stacked panels.

8. An expandable respiratory protection device, comprising:

a first half body and a second half body in a plane shape, each of the first and second half bodies comprising:

a plurality of mountain folds protruding outward;

a plurality of valley folds denting inward; and a side and a periphery, the side and the periphery together surrounding the corresponding half body, the periphery comprising:

two fold-gathering regions, the plurality of mountain folds and the plurality of valley folds being closed and fixed at the two fold-gathering regions, wherein:

wherein the plurality of mountain folds and the plurality of valley folds of the first and second half bodies are parallel and arranged alternatingly, the side of the first half body merges with the side of the second half body, such that the first half body and the second half body are located on opposite sides of a transverse axis defined by two ends of the side connecting the first half body and the second half body, the adjacent fold-gathering regions of the first half body and the second half body together form two concave notches, each of the two concave notches being at one of the two ends of the side, each of the two concave notches comprises a pair of straight lines joined by a curved line, and the expandable respiratory protection device expands and forms a chamber and each of the pair of straight lines moves closer to be parallel to each other when:

a portion of the periphery between the two fold-gathering regions of the first half body and a portion of the periphery between the two fold-gathering regions of the second half body move away from each other along a direction perpendicular to the transverse axis, such that the plurality of mountain folds and the plurality of valley folds of the first and second half bodies open and centers of the plurality of mountain folds and the plurality of valley folds of the first and second half bodies move away from the transverse axis radially, and the adjacent fold-gathering regions of the first and second half bodies move toward each other, such that the first half and the second half body become arched.

9. The expandable respiratory protection device of claim 8, further comprising adhesive distributed on bottom surfaces of the peripheries of the first half body and the second half body.

10. The expandable respiratory protection device of claim 9, wherein an amount of the adhesive distributed on a portion of the periphery is higher than an amount of the adhesive distributed on another portion of the periphery.

11. The expandable respiratory protection device of claim 9, wherein the adhesive comprises a pressure sensitive adhesive material.

12. The expandable respiratory protection device of claim 8, further comprising a sealing layer on bottoms of the first half body and the second half body, the sealing layer comprising adhesive for adhering an entire edge of the chamber formed by the expandable respiratory protection device to an object.

13. The expandable respiratory protection device of claim 8, further comprising a central fold perpendicular to the transverse axis and parallel to a vertical axis defined by centers of the side connecting the first half body and the second half body.

14. The expandable respiratory protection device of claim 8, wherein configurations of the plurality of mountain folds and the plurality of valley folds of the first half body are symmetrical to configurations of the plurality of mountain folds and the plurality of valley folds of the second half body.

15. A collapsible respiratory protection device, comprising:

a first set of parts and a second set of parts in arched states, wherein:

parts of each of the first set of parts and the second set of parts are joined one by one at long sides to form a chamber and are fixed together at two of short sides, one of the long sides of an uppermost part of the first set merges with one of the long sides of an uppermost part of the second set, such that the first set and the second set are located on opposite sides of a transverse axis defined by two ends of the long side connecting the uppermost parts of the first set and the second set, the adjacent short sides of the first set and the second set together form two concave notches, each of the two concave notches being at one of the two ends of the long sides, each of the two concave notches comprises a pair of straight lines joined by a curved line, each of the pair of straight lines moves closer to be parallel to each other when the first set of parts and the second set of parts are in the arched states, and the first set and the second set change into flattened states and the collapsible respiratory protection device collapses when:

the two short sides of the first set and the second set move away from each other to cause the parts of the first and second sets to flatten, and centers of the first set and the second set move toward the transverse axis radially until the parts of the first and second sets stack in a zig-zag pattern.

16. The collapsible respiratory protection device of claim 15, further comprising adhesive distributed on lowermost parts of the first set and the second set along an outer edge of the collapsible respiratory protection device.

17. The collapsible respiratory protection device of claim 16, wherein an amount of the adhesive distributed on a portion of the outer edge of the collapsible respiratory protection device is higher than an amount of the adhesive distributed on another portion of the edge of the collapsible respiratory protection device.

18. The collapsible respiratory protection device of claim 16, wherein the adhesive comprises a pressure sensitive adhesive material.

19. The collapsible respiratory protection device of claim 15, further comprising a sealing layer on lowermost parts of the first set and the second set, wherein the sealing layer comprises adhesive for adhering an entire edge of the chamber formed by the collapsible respiratory protection device to an object.

20. The collapsible respiratory protection device of claim 15, further comprising a central fold perpendicular to the transverse axis and parallel to a vertical axis defined by centers of the long sides of all of the parts.

21. The collapsible respiratory protection device of claim 15, wherein the zig-zag pattern of the first set is symmetrical to the zig-zag pattern of the second set.

22. The collapsible respiratory protection device of claim 15, wherein if the first set and the second set are initially in the flattened states, the collapsible respiratory protection device expands to form the chamber in the arched states when:

the centers of the first set and the second set move away from the transverse axis radially, such that the parts of the first and second sets unstack and join each other angularly, and the short sides of the first set and the second set move toward each other, such that the parts become arched.

23. A collapsible respiratory protection device, comprising:

a first half body and a second half body in arched states and forming a chamber, each of the first and second half bodies comprising:

a plurality of mountain folds protruding outward;

a plurality of valley folds denting inward; and a side and a periphery, the side and the periphery together surrounding the corresponding half body, the periphery comprising:

two fold-gathering regions, the plurality of mountain folds and the plurality of valley folds being closed and fixed at the two fold-gathering regions, wherein:

the side of the first half body merges with the side of the second half body, such that the first half body and the second half body are located on opposite sides of a transverse axis defined by two ends of the side connecting the first half body and the second half body, the adjacent fold-gathering regions of the first half body and the second half body together form two concave notches, each of the two concave notches being at one of the two ends of the side, each of the two concave notches comprises a pair of straight lines joined by a curved line, each of the pair of straight lines moves closer to be parallel to each other when the first and second half bodies are in the arched states, and the collapsible respiratory protection device changes to flattened states and collapses when:

the adjacent fold-gathering regions of the first and second half bodies move away from each other, such that first and second half bodies move toward the transverse axis radially and become flattened.

24. The collapsible respiratory protection device of claim 23, further comprising adhesive distributed on bottom surfaces of the peripheries of the first half body and the second half body.

25. The collapsible respiratory protection device of claim 24, wherein an amount of the adhesive distributed on a portion of the periphery is higher than an amount of the adhesive distributed on another portion of the periphery.

26. The collapsible respiratory protection device of claim 24, wherein the adhesive comprises a pressure sensitive adhesive material.

27. The collapsible respiratory protection device of claim 24, further comprising a sealing layer on a bottom of the first half body and the second half body, wherein the sealing layer comprises adhesive for adhering an entire edge of the chamber formed by the collapsible respiratory protection device to an object.

28. The collapsible respiratory protection device of claim 23, further comprising a central fold perpendicular to the transverse axis and parallel to a vertical axis defined by centers of the side connecting the first half body and the second half body.

29. The collapsible respiratory protection device of claim 23, wherein configurations of the plurality of mountain folds and the plurality of valley folds of the first half body are symmetrical to configurations of the plurality of mountain folds and the plurality of valley folds of the second half body.

30. The collapsible respiratory protection device of claim 23, wherein if the first half body and the second half body are initially in the flattened states, the collapsible respiratory protection device expands to form the chamber in the arched states when:

a portion of the periphery between the two fold-gathering regions of the first half body and a portion of the periphery between the two fold-gathering regions of the second half body move away from each other along a direction perpendicular to the transverse axis, such that the plurality of mountain folds and the plurality of valley folds of the first and second half bodies open and centers of the plurality of mountain folds and the plurality of valley folds of the first and second half bodies move away from the transverse axis radially, and the adjacent fold-gathering regions of the first and second half bodies move toward each other, such that the first half body and the second half body become arched.

31. A flexible respiratory protection device, comprising:

a main body made of a soft material and comprising:

a first set of parts and a second set of parts in arched states, wherein parts of each of the first set and the second set of the parts are joined one by one at long sides to form a chamber and are fixed together at two of short sides, one of the long sides of an uppermost part of the first set merges with one of the long sides of an uppermost part of the second set, such that the first set and the second set are located on opposite sides of a transverse axis defined by two ends of the long side connecting the uppermost parts of the first set and the second set, the adjacent short sides of the first set and the second set together form two concave notches, each of the two concave notches being at one of the two ends of the long sides, each of the two concave notches comprises a pair of straight lines joined by a curved line, and each of the pair of straight lines moves closer to be parallel to each other when the first set of parts and the second set of parts are in the arched states; and adhesive applied to an outer edge of the main body for adhering the flexible respiratory protection device to two sites on an object, wherein when the two sites of the object move in respect to each other, the first set and the second set move in conjunction with movement of the two sites and at least one angle between two adjacent parts of the first and second sets changes, such that the flexible respiratory protection device remains adhered to the object.

32. The flexible respiratory protection device of claim 31, wherein the adhesive is applied to the entire outer edge of the flexible respiratory protection device.

33. The flexible respiratory protection device of claim 31, wherein an amount of the adhesive distributed on a portion of the outer edge of the flexible respiratory protection device is higher than an amount of the adhesive distributed on another portion of the outer edge of the flexible respiratory protection device.

34. The flexible respiratory protection device of claim 31, wherein the adhesive comprises a pressure sensitive adhesive material.

35. The flexible respiratory protection device of claim 31, wherein the soft material comprises a plurality of air permeable layers sealed together at a periphery of the main body.

36. The flexible respiratory protection device of claim 31, further comprising a central fold perpendicular to the transverse axis and parallel to a vertical axis defined by centers of the long sides of the first set and the second set.

37. The flexible respiratory protection device of claim 31, wherein configurations of the parts of the first set and the second set are symmetrical to each other.

38. A flexible respiratory protection device, comprising:

a main body made of a soft material and comprising a first half body and a second half body in an arched shape to form a chamber, each of the first and second half bodies comprising:

a plurality of mountain folds protruding outward;

a plurality of valley folds denting inward, wherein the plurality of mountain folds and the plurality of valley folds of the first and second half bodies are arranged alternatingly; and a side and a periphery, the side and the periphery together surrounding the corresponding half body, the periphery comprising:

two fold-gathering regions, the plurality of mountain folds and the plurality of valley folds of the first and second half bodies being closed and fixed at two the fold-gathering regions, wherein:

the side of the first half body merges with the side of the second half body, such that the first half body and the second half body are located on opposite sides of a transverse axis defined by two ends of the side connecting the first half body and the second half body, the adjacent fold-gathering regions of the first half body and the second half body together form two concave notches, each of the two concave notches being at one of the two ends of the side, each of the two concave notches comprises a pair of straight lines joined by a curved line, each of the pair of straight lines moves closer to be parallel to each other when the first and second half bodies are in arched states; and adhesive formed at an outer edge of the main body for adhering the flexible respiratory protection device to two sites on an object, wherein when the two sites of the object move in respect to each other, the first half body and the second half body move in conjunction with movement of the two sites and at least one angle between two adjacent folds of the first and second half bodies changes, such that the flexible respiratory protection device remains adhered to the object.

39. The flexible respiratory protection device of claim 38, further comprising a central fold perpendicular to the transverse axis and parallel to a vertical axis defined by centers of the side connecting the first half body and the second half body.

40. The flexible respiratory protection device of claim 38, wherein configurations of the plurality of mountain folds and the plurality of valley folds of the first half body are symmetrical to configurations of the plurality of mountain folds and the plurality of valley folds of the second half body.

41. A respiratory protection device comprising:

a main body comprising one barrier layer, short sides of the barrier layer together forming two concave notches, each of the two concave notches being on one of the short sides; and adhesive applied to an outer edge of the main body for adhering the respiratory protection device to an object, wherein:

the main body is manufactured by forming a first set of zig-zag folds and a second set of zig-zag folds on two opposite long sides of the barrier layer, closing and fixing two ends of each of the first set and the second set on two opposite short sides of the barrier layer, each of the concave notches comprises a pair of straight lines joined by a curved line, and each of the pair of straight lines moves closer to be parallel to each other when the first set of zig-zag folds and the second set of zig-zag folds are in arched states.

42. The respiratory protection device of claim 41, wherein the adhesive is applied to the entire outer edge of the respiratory protection device.

43. The respiratory protection device of claim 41, wherein an amount of the adhesive in a portion of the outer edge of the respiratory protection device is higher than an amount of the adhesive in another portion of the outer edge.

44. The respiratory protection device of claim 41, wherein the adhesive is applied along a non-linear track comprising one or more crossed points on the track.

45. The respiratory protection device of claim 41, wherein the adhesive comprises a pressure sensitive adhesive material.

46. The respiratory protection device of claim 41, wherein the zig-zag folds of the first set are symmetrical to the zig-zag folds of the second set.

47. The respiratory protection device of claim 41, wherein the respiratory protection device is folded at a central fold formed perpendicularly across the first set and the second set of the main body.

48. The respiratory protection device of claim 41, further comprising a releasing liner covering the adhesive for preventing the adhesive from adhered to each other when the respiratory protection device is folded along a central fold.

49. A method for manufacturing a respiratory protection device, comprising:

providing one barrier layer;

forming a first set of zig-zag folds and a second set of zig-zag folds on two opposite long sides of the barrier layer;

closing and fixing two ends of the first set and the second set on two opposite short sides of the barrier layer;

cutting the short sides of the barrier layer to form a concave notch on each of the short sides; and applying adhesive on an outer edge of the barrier layer for allowing the respiratory protection device to be adhered to an object, wherein:

each of the concave notches comprises a pair of straight lines joined by a curved line, and each of the pair of straight lines moves closer to be parallel to each other when the first set of zig-zag folds and the second set of zig-zag folds are in arched states.

50. The method for manufacturing the respiratory protection device of claim 49, wherein the adhesive is applied to the entire outer edge of the respiratory protection device.

51. The method for manufacturing the respiratory protection device of claim 49, wherein an amount of the adhesive on a portion of the outer edge of the respiratory protection device is higher than an amount of the adhesive in another portion of the outer edge.

52. The method for manufacturing the respiratory protection device of claim 49, wherein the adhesive is applied along a non-linear track comprising one or more crossed points on the track.

53. The method for manufacturing the respiratory protection device of claim 49, wherein the adhesive comprises a pressure sensitive adhesive material.

54. The method for manufacturing the respiratory protection device of claim 49, wherein the zig-zag folds of the first set are symmetrical to the zig-zag folds of the second set.

55. The method for manufacturing the respiratory protection device of claim 49, further comprising:

folding the respiratory protection device in half, such that the adhesive faces an inner side of the folded respiratory protection device; and placing a releasing liner between the adhesive.

* * * * *